US007946339B2

(12) United States Patent
So et al.

(10) Patent No.: US 7,946,339 B2
(45) Date of Patent: May 24, 2011

(54) MULTIFLUID HEAT EXCHANGER

(75) Inventors: Allan K. So, Mississauga (CA); Mark S. Kozdras, Fergus (CA)

(73) Assignee: Dana Canada Corporation, Oakville, Ontario (CA)

( * ) Notice: Subject to any disclaimer, the term of this patent is extended or adjusted under 35 U.S.C. 154(b) by 1230 days.

(21) Appl. No.: 11/381,863

(22) Filed: May 5, 2006

(65) Prior Publication Data

US 2006/0266501 A1 Nov. 30, 2006

Related U.S. Application Data

(60) Provisional application No. 60/684,037, filed on May 24, 2005.

(51) Int. Cl.
*F28D 9/00* (2006.01)

(52) U.S. Cl. ..... 165/140; 165/167

(58) Field of Classification Search ..... 165/140
See application file for complete search history.

(56) References Cited

U.S. PATENT DOCUMENTS

| | | | | |
|---|---|---|---|---|
| 3,207,216 | A * | 9/1965 | Donaldson | 165/148 |
| 3,537,513 | A | 11/1970 | Austin | |
| 3,752,222 | A | 8/1973 | Olbermann, Jr. | |
| 4,002,201 | A | 1/1977 | Donaldson | |
| 4,081,025 | A | 3/1978 | Donaldson | |
| 4,249,597 | A | 2/1981 | Carey | |
| 4,327,802 | A * | 5/1982 | Beldam | 165/153 |
| 4,462,463 | A | 7/1984 | Gorham, Jr. | |
| 4,479,533 | A | 10/1984 | Persson et al. | |
| 5,180,004 | A * | 1/1993 | Nguyen | 165/140 |
| 5,408,843 | A | 4/1995 | Lukas et al. | |
| 5,462,113 | A | 10/1995 | Wand | |
| 5,538,077 | A | 7/1996 | So et al. | |
| 5,720,341 | A * | 2/1998 | Watanabe et al. | 165/135 |
| 5,884,696 | A | 3/1999 | Loup | |
| 5,893,411 | A | 4/1999 | Nir | |
| 5,964,280 | A | 10/1999 | Wehrmann et al. | |
| 5,964,282 | A | 10/1999 | Seiler et al. | |
| 6,142,221 | A | 11/2000 | Johansson | |
| 6,164,371 | A | 12/2000 | Bertilsson | |
| 6,305,466 | B1 * | 10/2001 | Andersson et al. | 165/140 |
| 6,321,832 | B1 | 11/2001 | Le | |
| 6,564,862 | B1 * | 5/2003 | Persson | 165/140 |
| 6,732,790 | B2 * | 5/2004 | Brochin et al. | 165/140 |
| 6,786,276 | B2 | 9/2004 | Samy et al. | |
| 6,889,758 | B2 | 5/2005 | Burgers et al. | |
| 6,923,251 | B2 | 8/2005 | Higashiyama | |
| 7,036,572 | B2 | 5/2006 | Sohn | |
| 7,051,789 | B2 | 5/2006 | Sheppard | |
| 7,152,671 | B2 | 12/2006 | Shibagaki et al. | |
| 7,264,045 | B2 | 9/2007 | Mehendale et al. | |
| 7,380,544 | B2 * | 6/2008 | Raduenz et al. | 123/568.12 |
| 2005/0133210 | A1 | 6/2005 | Inagaki et al. | |
| 2005/0150646 | A1 | 7/2005 | Calhoun et al. | |
| 2006/0266501 | A1 | 11/2006 | So et al. | |

FOREIGN PATENT DOCUMENTS

| | | |
|---|---|---|
| JP | 61059188 | 3/1986 |

* cited by examiner

*Primary Examiner* — Allen J Flanigan
(74) *Attorney, Agent, or Firm* — Marshall & Melhorn, LLC

(57) ABSTRACT

A heat exchanger has a pair of heat exchange conduits having adjacent primary heat exchange surfaces thermally coupled together for the transfer of heat energy between the conduits. A third fluid conduit has a primary heat transfer surface thermally coupled to the primary heat transfer surfaces of the pair of fluid conduits, so that heat can be transferred between any one of the fluid conduits and each of the other fluid conduits.

20 Claims, 6 Drawing Sheets

MULTIFLUID HEAT EXCHANGER

RELATED APPLICATIONS

This application claims priority from U.S. provisional patent application Ser. No. 60/684,037 filed May 24, 2005, which is incorporated herein by reference.

FIELD OF THE INVENTION

This invention relates to heat exchangers, and in particular, to heat exchangers for transferring heat energy between more than two fluids.

BACKGROUND OF THE INVENTION

In some applications, such as automotive vehicle manufacturing, it is common to have multiple heat exchangers for cooling or heating various different fluids that are used in the application. For example, in the case of an automobile, it is common to have a radiator for cooling the engine coolant, and one or more other heat exchangers for cooling such fluids as engine oil, transmission oil or fluid, power steering fluid, etc. Usually, air is used to cool the engine coolant, and often the engine coolant itself is used to cool the other fluids, such as engine or transmission oil or power steering fluid. As may be appreciated, this usually involves a lot of plumbing, and in automotive applications, it is highly undesirable to have too many components that need to be assembled into the automobile, as that increases the cost of assembly, provides more components that can break down, and it takes up valuable space, which is always in short supply.

In an attempt to reduce the amount of plumbing required and to save space, it has been proposed to combine two heat exchanger functions or heat exchanger subassemblies into a combination heat exchanger, where one of the fluids, such as engine coolant is shared between the two subassembly heat exchangers. An example of this is shown in U.S. Pat. No. 4,327,802 issued to Beldam, where the same engine coolant used in the radiator is used in an oil cooler subassembly formed integrally with the radiator. In this Beldam heat exchanger, air is used to cool engine coolant and in turn, the engine coolant is used to cool oil.

U.S. Pat. No. 5,884,696 (Loup) is another combination heat exchanger, where interleaved fluid flow passages are used to put two heat exchangers in parallel and reduce the overall size of what would otherwise be too separate heat exchangers. In this device, adjacent flow passages for the two heat exchange fluids, such as engine coolant and refrigerant, are separated by air passages for heat transfer between the two heat exchange fluids and the air.

Yet another example of a combination heat exchanger where heat energy is transferred between a common fluid and two other fluids is shown in U.S. Pat. No. 5,462,113. In this device, two refrigerant circuits with alternating spaced-apart flow passages are provided, and a third heat exchange fluid, such as water, surrounds all of the refrigerant circuit flow passages, so that maximum exposure of the water to the refrigerant is achieved.

While all of the above-mentioned prior art devices achieve the desired result of compact design and simplification of the plumbing, they are all concerned with transferring heat between one common fluid and two other fluids. They are not concerned with transferring heat energy between the two other fluids per se, and consequently, they are not very efficient at doing that.

SUMMARY OF THE INVENTION

In the present invention, three or more fluid passages or conduits are provided where heat energy can be transferred efficiently between any one of the fluid conduits and each of the other fluid conduits.

According to the invention, there is provided a heat exchanger comprising a plurality of stacked heat exchange modules. Each module includes a first fluid conduit having a first primary heat transfer surface, and a second fluid conduit having a second primary heat transfer surface. The first primary heat transfer surface is thermally coupled to the second primary heat transfer surface. Each module also has a third fluid conduit having a third primary heat transfer surface thermally coupled to both of the first and second primary heat transfer surfaces, so that heat can be transferred between any one of the fluid conduits and each of the other conduits.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
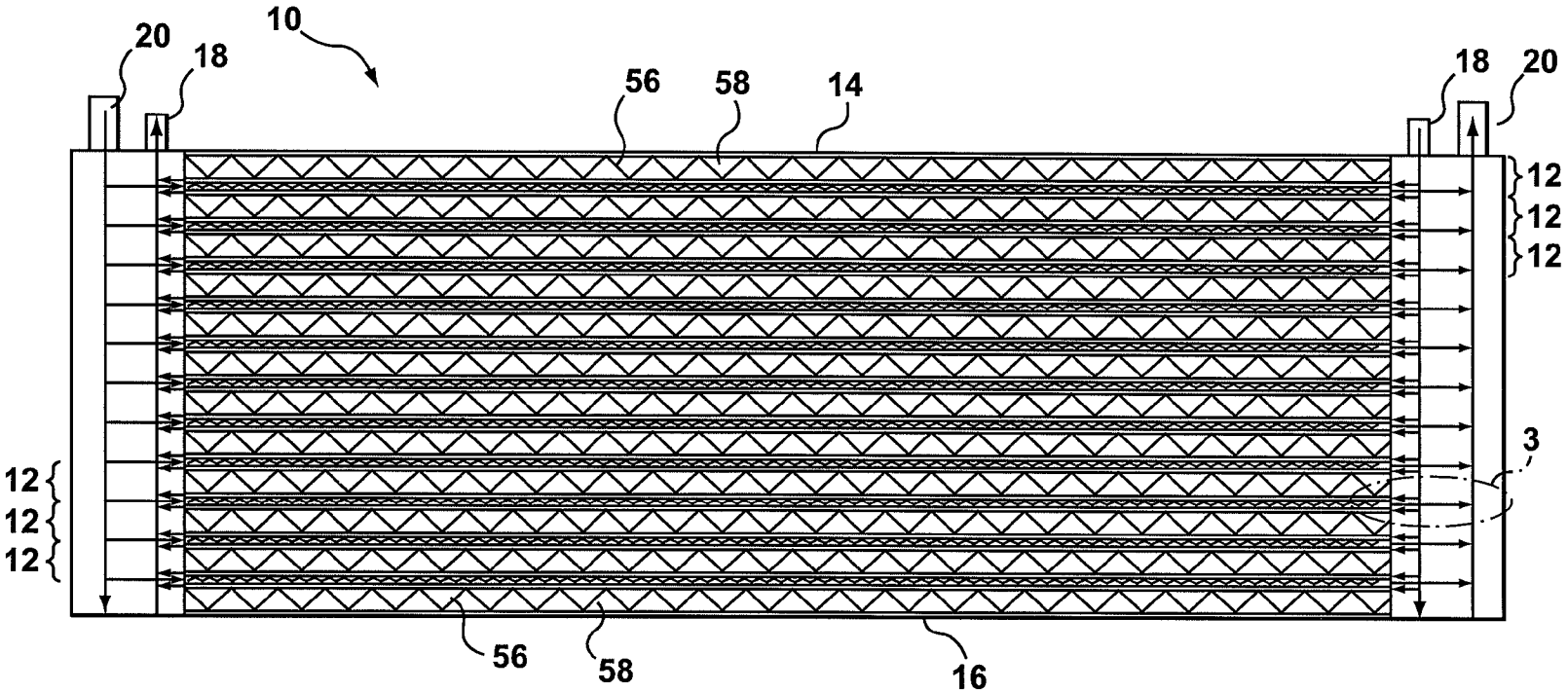
FIG. 1 is a diagrammatic elevational view of a preferred embodiment of a heat exchanger according to the present invention.
Figure 2:
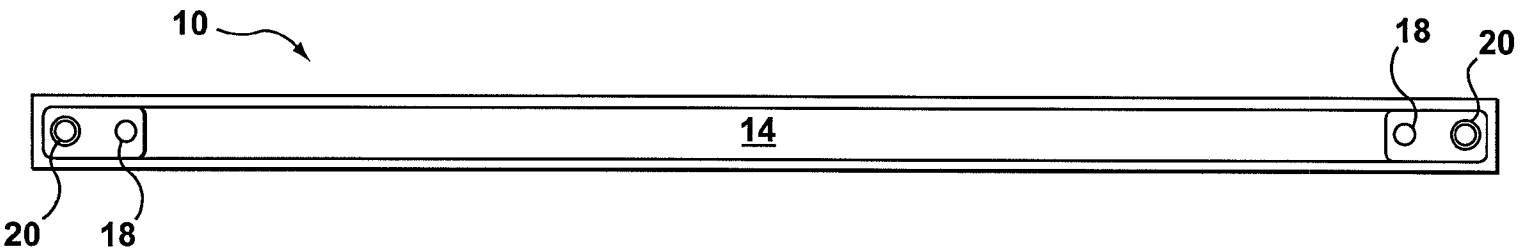
FIG. 2 is a top plan view of the heat exchanger shown in FIG. 1.

Referring first to FIGS. 1-7, a first preferred embodiment of a heat exchanger according to the present invention is generally indicated by reference numeral 10. Heat exchanger 10 is formed of a plurality of stacked heat exchange modules 12, the right hand end of one of which is shown best in FIG. 4. Heat exchanger 10 also has a top plate 14 and a bottom plate 16, a pair of inner nipples 18 and a pair of outer nipples 20. The inner and outer nipples 18, 20 form the inlets and outlets for two of the heat exchange fluids used in heat exchanger 10, as will be described further below.

Each heat exchange module 12 is formed by a pair of spaced-apart plates 22,24 and a pair of back-to-back intermediate plates 26,28. The spaced-apart plates 22,24 are identical, one of them just being turned upside down. Similarly, intermediate plates 26, 28 are identical, one of them again just being turned upside down. Intermediate plates 26,28 are formed with undulations 30 in the form of parallel ribs 32 and grooves 34. A rib 32 on one of the plates 26,28 becomes a groove 34 when the plate is turned upside down. Ribs and grooves 32,34 are obliquely orientated, so that they cross when the intermediate plates 26, 28 are put together and thus form an undulating longitudinal flow path or conduit 36 (see FIG. 7) between the intermediate plates 26 and 28. When the top spaced-apart plate 22 is placed against the intermediate plate 26, the ribs 32 on intermediate plate 26 engage the underside of top plate 22 and provide a tortuous longitudinal flow path 38 between plates 22 and 26. A similar tortuous longitudinal flow path or conduit 40 is formed between plates 28 and 24.

Although two intermediates plates 26, 28 are shown in FIGS. 3 to 7, it will be appreciated that only one of the intermediate plates 26, 28 is required. This would still give either the longitudinal fluid conduits 36, 38 (if only intermediate plate 26 is used), or fluid conduits 36, 40 (if only intermediate plate 28 is used).

Intermediate plates 26, 28 are formed with bosses 42 defining inlet or outlet openings 44. The bosses 42 and inlet/outlet openings 44 are located near each end of the plates to allow fluid to pass through the central longitudinal flow path 36 between intermediate plates 26, 28. Intermediate plates 26, 28 also have inlet/outlet openings 46 near the ends of the plates to allow a second fluid to pass through the back-to-back intermediate plates 26, 28 and flow through the longitudinal fluid conduits 38 and 40, respectively, between plates 22, 26 and 28, 24.

Figure 3:
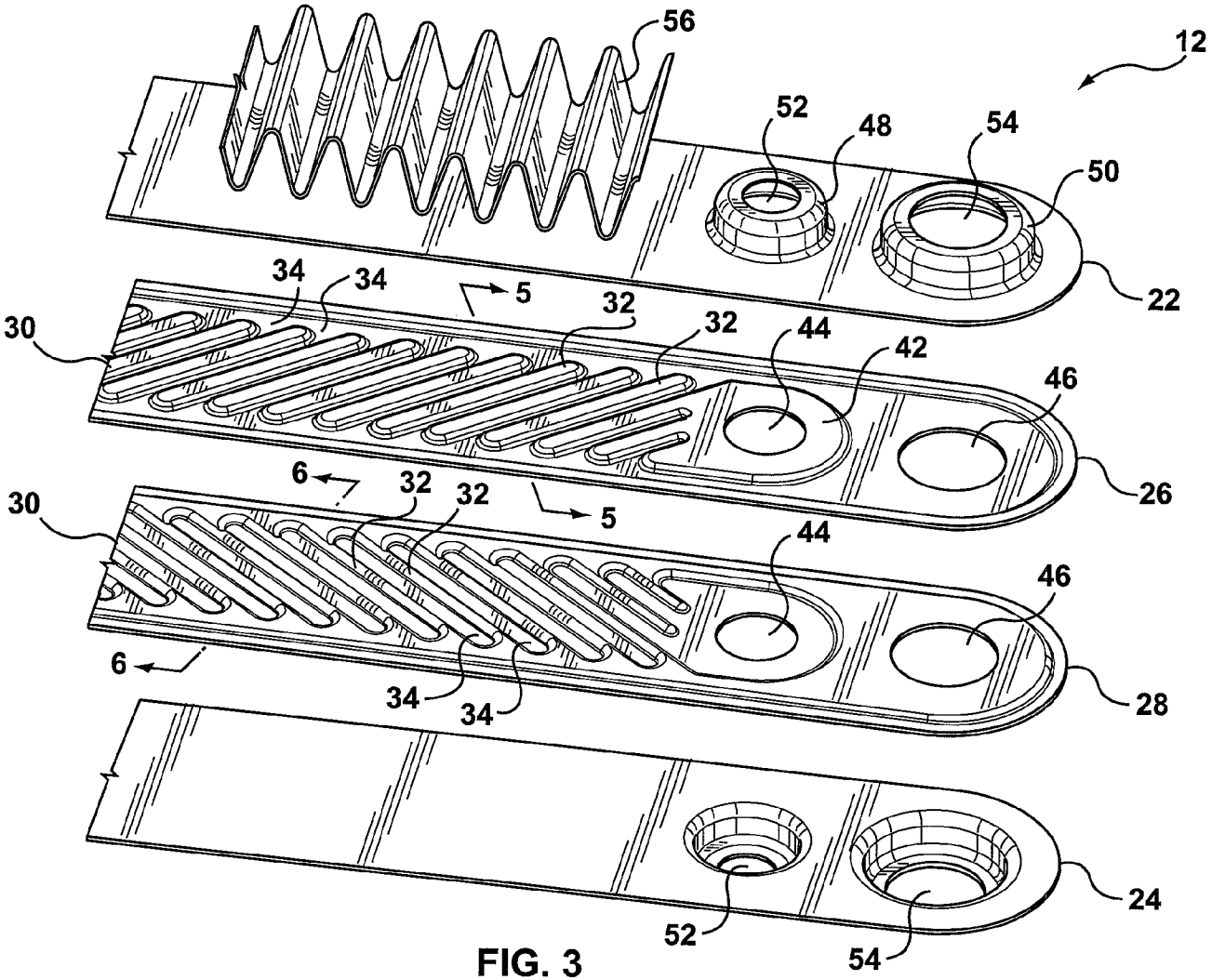
FIG. 3 is an enlarged, exploded perspective view of the encircled area 3 of FIG. 1.
Figure 4:
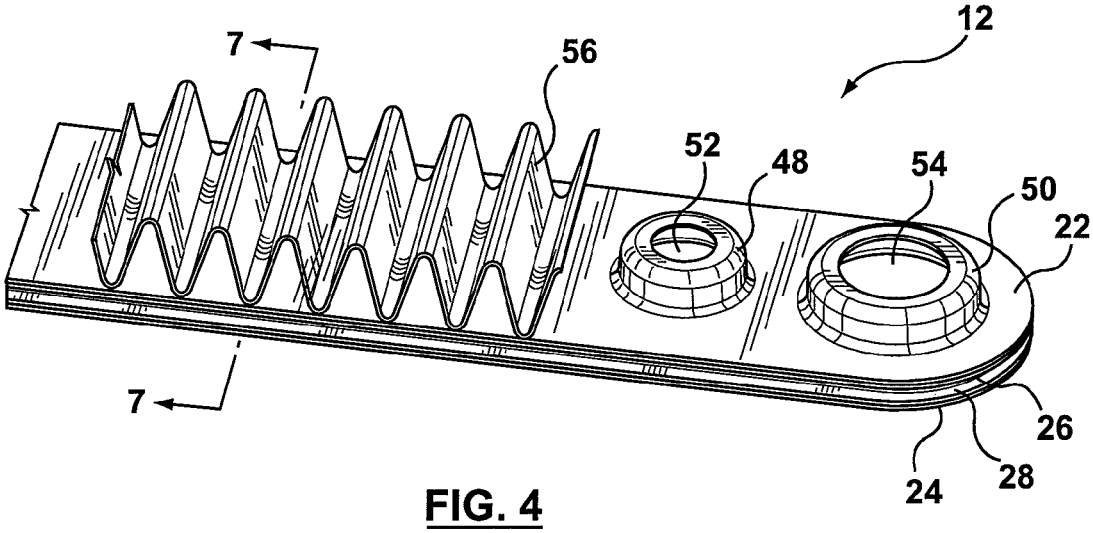
FIG. 4 is a perspective view of the assembled components shown in FIG. 3.
Figure 5:
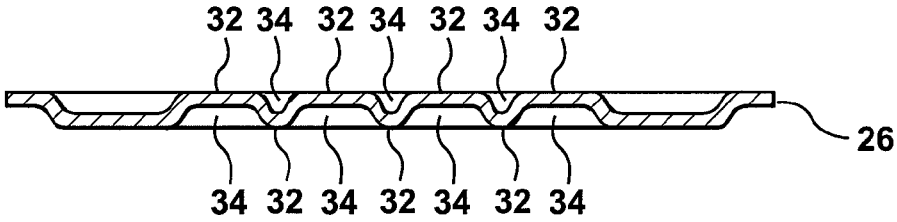
FIG. 5 is a cross-sectional view taken along lines 5-5 of FIG. 3.
Figure 6:
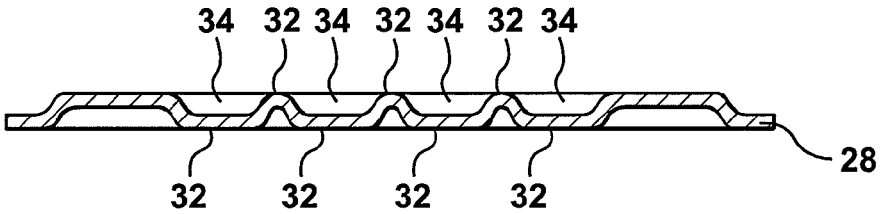
FIG. 6 is a cross-sectional view taken along lines 6-6 of FIG. 3.
Figure 7:
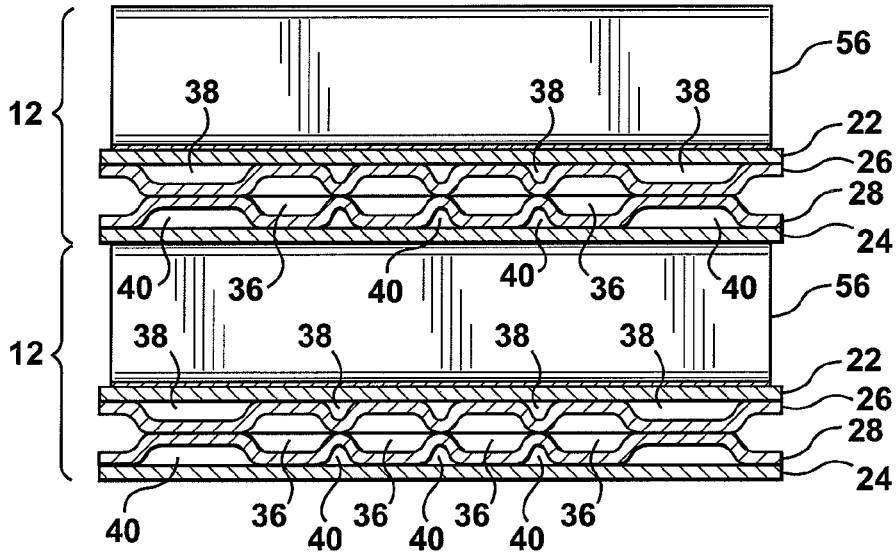
FIG. 7 is a cross-sectional view taken along lines 7-7 of FIG. 4, but showing two stacked heat exchange modules.

As seen best in FIG. 3, spaced-apart plates 22, 24 are also formed with bosses 48 and 50 defining respectively inlet/outlet openings 52, 54. Inlet/outlet openings 52 communicate with the fluid or flow path conduits 36, and the inlet/outlet openings 54 communicate with the longitudinal flow paths or conduits 38 and 40. It will be appreciated that the openings 52, 54 at each end of the modules 12 could be either inlet openings or outlet openings depending upon the direction of flow desired through module 12.

Each module 12 also has a heat transfer fin 56 attached thereto. The plates and fins of heat exchanger 10 are preferably formed of brazing clad aluminum, although the fins 56 could be formed of a plain aluminum alloy, so that all of the plates and fins can be assembled and joined together in a brazing furnace.

Bosses 48, 50 extend in height approximately one-half the height of fins 56, to ensure good contact between the fins 56 and plates 22, 24 during the brazing process. Bosses 48,50 extend outwardly, so that the bosses in adjacent heat exchange modules 12 engage to form flow manifolds.

In use, a fluid flow passage or conduit 36 between intermediates plates 26, 28 could be considered to be a first fluid conduit, and either of the flow passages or conduits 38 or 40 could be considered to be a second fluid conduit. Each of these first and second fluid conduits has a primary heat transfer surface in the form of the common wall between them. The first primary heat transfer surface is thermally coupled to the second primary heat transfer surface allowing heat transfer between the respective fluids passing through inlet/outlet openings 52, 54. The spaced-apart plates 22,24 in adjacent modules 12 define third fluid conduits in which the fins 56 are located. It will be appreciated that a third fluid conduit is located on one side of the first and second conduits, and the third fluid conduit of an adjacent heat exchange module is located on the opposite side of the first and second conduits. For the purposes of this disclosure, the first and second fluid conduits are considered to be tubular members disposed in juxtaposition. The third fluid conduits, in the form of air passages 58 containing fins 56, are located laterally adjacent to the first and second fluid conduits, and also have primary heat transfer surfaces being the wall portions of plates 22 and 24 located between the air passages 58 and the fluid conduits 38 and 40. These third primary heat transfer surfaces are thermally coupled to both of the first and second primary heat transfer surfaces formed by intermediate plates 26,28, so that heat can be transferred between any one of the fluid conduits and each of the other fluid conduits thermally coupled thereto by the primary heat transfer surfaces therebetween. For the purposes to this disclosure, the term thermally coupled means being capable of transferring heat energy through at least one wall separating the adjacent conduits.

For example, in an automotive application, if the fluid conduit 36 located centrally between intermediate plates 26, 28 is considered to be the first fluid conduit, it would have a first primary heat transfer surface in the form of the undulating walls or ribs and grooves 32, 34 forming this conduit. This first fluid conduit could be used for the flow of engine oil or transmission fluid through heat exchanger 10. A second fluid conduit could be the flow passage or conduit 38, and it could be considered to have a second primary heat transfer surface, which again is the undulations 30 that form the ribs and grooves 32, 34 in intermediate plate 26. Engine coolant could pass through this second fluid conduit 38 to cool the oil in the first fluid conduit 36. The third fluid conduit, which of course would be the air passage 58 above plate 22, would allow air as the heat transfer fluid to cool both the oil or transmission fluid in the first fluid conduit 36 and the engine coolant in the second fluid conduit 38. This would be the normal operation of heat exchanger 10. However, in engine start-up conditions on a warm day, where the oil or transmission fluid in first fluid conduit 36 is relatively cold and viscous, the air passing through air passages 58 could actually help to warm up the oil in first conduit 36, and in extremely cold ambient conditions, where the air might not warm up the oil in first conduit 36, as the engine starts to warm up, the coolant flowing through the second fluid conduit 38 could warm up the oil very quickly.

It will be appreciated that the choice of fluids flowing through the first and second fluid conduits 36 and 38 could be reversed, or there could be other fluids such as fuel, or refrigerant that could be passed through the first and second conduits. In fact, with the addition of side or lateral manifold plates, fluids other than air could be passed through the spaces or third conduits containing fins 56. Also, fins 56 are shown to be aligned perpendicularly or transversely in the modules 12, but they could be orientated differently to give other than transverse flow through modules 12.

Figure 8:
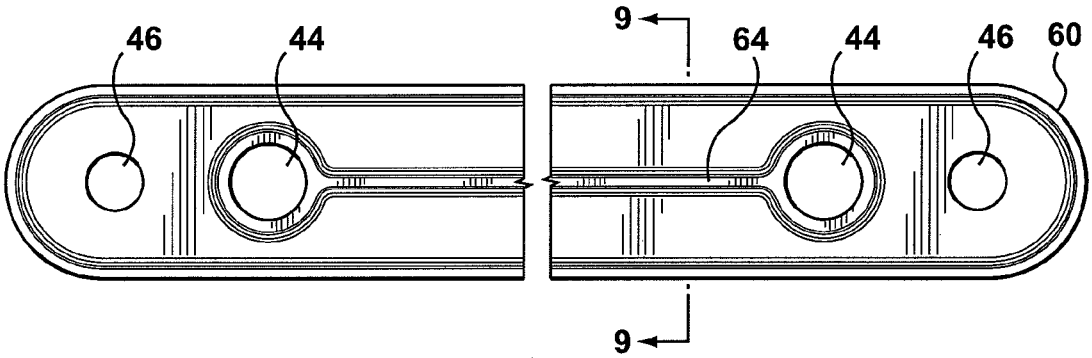
FIG. 8 is a plan view of a heat exchanger plate used to make another preferred embodiment of a heat exchanger according to the present invention.
Figure 9:
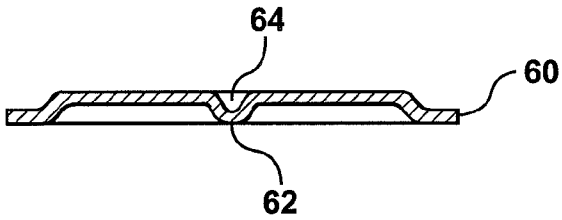
FIG. 9 is a cross-sectional view taken along lines 9-9 of FIG. 8.
Figure 10:
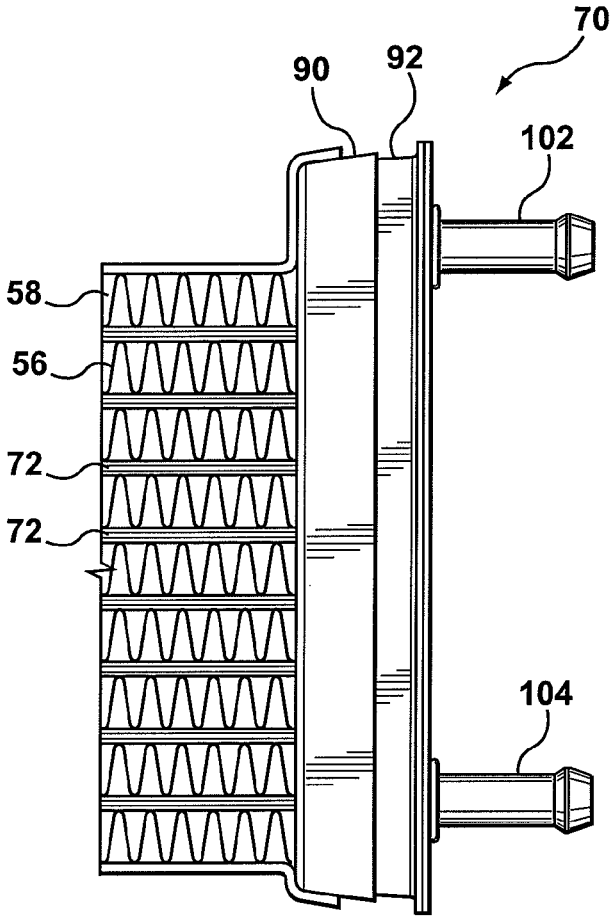
FIG. 10 is a partial elevational view of the right hand end of another preferred embodiment of a heat exchanger according to the present invention.
Figure 11:
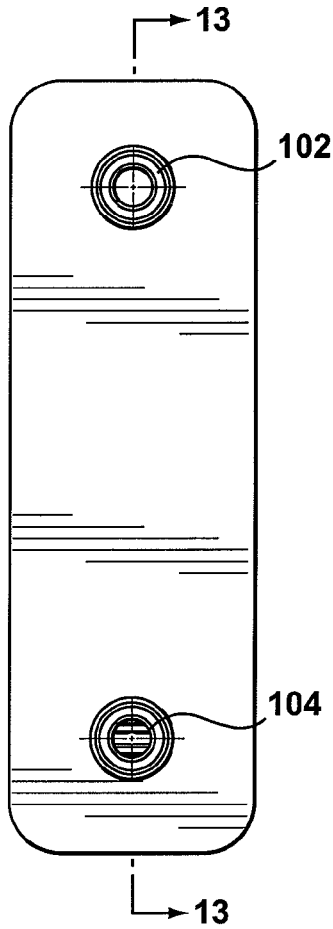
FIG. 11 is a right side view of the heat exchanger shown in FIG. 10.
Figure 12:
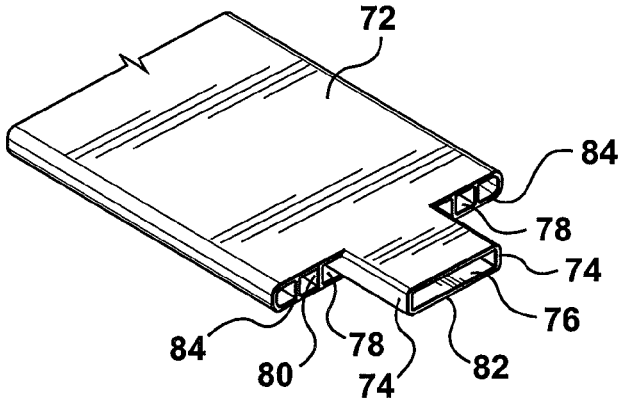
FIG. 12 is a perspective view of the extruded conduits used in the heat exchanger of FIG. 10.
Figure 13:
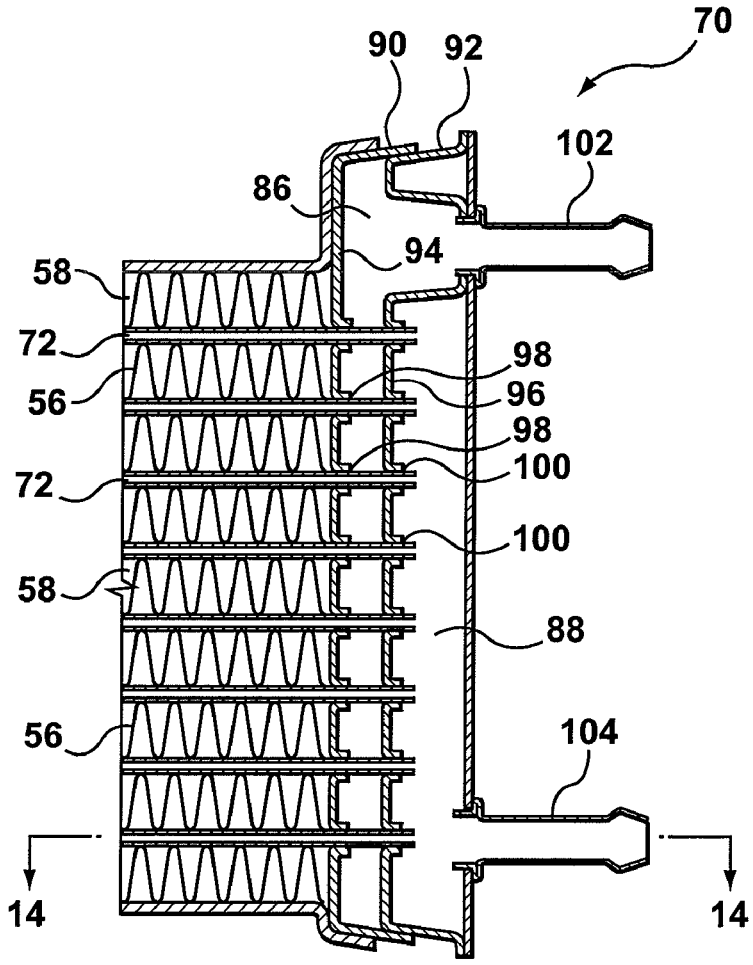
FIG. 13 is a cross-sectional view taken along lines 13-13 of FIG. 11.
Figure 14:
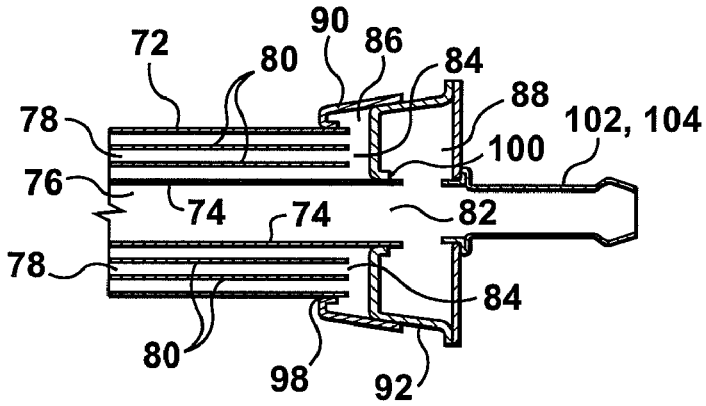
FIG. 14 is a cross-sectional view taken along lines 14-14 of FIG. 13.

Referring next to FIGS. 8 and 9, another preferred embodiment of an intermediate plate 60 is shown where, instead of having obliquely orientated ribs and grooves 32, 34 as in the case of intermediate plates 26, 28, a single longitudinal rib and groove 62, 64 is formed in the intermediate plates 60. This would provide a single central longitudinal first fluid conduit between the back-to-back intermediate plates 60, and a larger second fluid conduit surrounding this central first fluid conduit. In this case, engine oil or transmission fluid could be passed through inlets/outlets 46, and engine coolant through inlet/outlet openings 44, and with the larger flow area for the oil, turbulizers or other flow augmentation could be used on the oil side of the heat exchanger. It is also possible to locate the rib and groove 62, 64 closer to one side of plates 60 than the other, or to have them follow a path other than a straight line between the inlet/outlet openings 44.

Referring next to FIGS. 10 to 14, another preferred embodiment of a heat exchanger according to the present invention is generally indicated by reference numeral 70. In the heat exchanger 70, the first and second fluid conduits or tubular members are formed by an extruded tube 72. Extruded tube 72 has internal longitudinal inner wall portions 74 forming dividers to provide a central flow passage or fluid conduit 76 and peripheral portions or conduits 78 on either side of the central conduits 76. The peripheral conduits 78 can also have divider walls 80 for strengthening purposes. The central fluid conduit could be one of the first and second fluid conduits, and either or both of the peripheral fluid conduits 78 could be the other of the first and second fluid conduits.

Extruded tube 72 has discrete open end portions 82 and 84 to define inlet/outlet openings for each of the first and second conduits. As seen best in FIGS. 13 and 14, manifolds 86 and 88 supply and return fluid from the respective fluid conduits 76, 78. Manifolds 86, 88 are formed of nested dished members 90 and 92 that have respective dish bottoms 94, 96 that define spaced openings 98, 100 to accommodate the respective extruded tube open end portions 82, 84. Nipples 102, 104 are the inlets and outlets for manifolds 86, 88. As in the case of the embodiment shown in FIGS. 1-9, a third fluid conduit is formed by the air passages 58 containing fins 56 located between and contacting the spaced-apart extruded tubes 72.

In heat exchanger 70, the primary heat transfer surfaces for the first and second fluid conduits would be the inner wall portions 74 and adjacent portions of the adjoining top and bottom wall portions of extruded tubes 72. The primary heat transfer surfaces between the first and second fluid conduits and the third fluid conduit or air passages 56 would be the top and bottom walls of extruded member or tube 72.

Having described preferred embodiments of the invention, it will be appreciated that various modifications may be made to the structures described above. For example, although the plates used in the various embodiments are shown as elongate plates having longitudinal axes, the plates could be other shapes or configurations. Although two inlet and outlet openings are located, spaced-apart, at each end of the elongate plates, the inlet and outlet openings could be positioned differently. The intermediate plates shown in FIGS. 1-9 actually have two nested flow passages, but the same principle could be applied to provide three or more nested flow passages, so that the heat exchangers of the present invention could handle more than three fluids. Similarly, in the embodiments shown in FIGS. 10-14, there could be additional, discrete open end portion like end portions 82, 84, and additional nested dishes could be used to accommodate more than three fluids in heat exchanger 70.

From the foregoing, it will be evident to persons of ordinary skill in the art that the scope of the present invention is limited only by the accompanying claims, purposively construed.

The invention claimed is:

1. A heat exchanger comprising:

a plurality of stacked heat exchanger modules each including a first fluid conduit having a first primary heat transfer surface, a second fluid conduit having a second primary heat transfer surface, the first primary heat transfer surface being thermally coupled to the second primary heat transfer surface; and a third fluid conduit having a third primary heat transfer surface, the third primary heat transfer surface being thermally coupled to both of said first and second primary heat transfer surfaces, so that heat can be transferred between any one of the fluid conduits and each of the other fluid conduits;

wherein the first and second fluid conduits are tubular members disposed in juxtaposition, and wherein the third fluid conduit is located generally laterally adjacent to and thermally coupled to both the first and second fluid conduits;

wherein the first and second fluid conduits are formed by a pair of spaced-apart plates and an intermediate plate located between the spaced-apart plates, the intermediate plate being formed with undulations defining, with the spaced-apart plates, said first and second fluid conduits, one of the spaced-apart plates defining inlet and outlet openings in communication with each of said first and second fluid conduits; and wherein said intermediate plate is a first intermediate plate, and further comprising a second undulate intermediate plate located back-to-back with the first intermediate plate.

2. A heat exchanger comprising:

a plurality of stacked heat exchanger modules each including a first fluid conduit having a first primary heat transfer surface, a second fluid conduit having a second primary heat transfer surface, the first primary heat transfer surface being thermally coupled to the second primary heat transfer surface; and a third fluid conduit having a third primary heat transfer surface, the third primary heat transfer surface being thermally coupled to both of said first and second primary heat transfer surfaces, so that heat can be transferred between any one of the fluid conduits and each of the other fluid conduits;

wherein the first and second fluid conduits are tubular members disposed in juxtaposition, and wherein the third fluid conduit is located generally laterally adjacent to and thermally coupled to both the first and second fluid conduits;

wherein the first and second fluid conduits are formed by a pair of spaced-apart plates and an intermediate plate located between the spaced-apart plates, the intermediate plate being formed with undulations defining, with the spaced-apart plates, said first and second fluid conduits, one of the spaced-apart plates defining inlet and outlet openings in communication with each of said first and second fluid conduits;

wherein said intermediate plate is a first intermediate plate, and further comprising a second undulated intermediate plate located back-to-back with the first intermediate plate, the second intermediate plate being identical to the first intermediate plate.

3. A heat exchanger as claimed in claim 1 wherein the third fluid conduit is located on one side of the first and second fluid conduits, and wherein the third fluid conduit of an adjacent heat exchange module is located on the opposite side of said first and second fluid conduits.

4. A heat exchanger as claimed in claim 1 wherein the third fluid conduits are orientated transversely of the first and second fluid conduits.

5. A heat exchanger as claimed in claim 1 wherein both of the spaced-apart plates have said inlet and outlet openings.

6. A heat exchanger as claimed in claim 5 wherein the spaced-apart plates are formed with bosses defining the inlet and outlet openings.

7. A heat exchanger as claimed in claim 6 wherein the bosses extend outwardly, the bosses in adjacent heat exchange modules engaging to form flow manifolds, the spaced-apart plates in adjacent modules thus defining the third fluid conduit therebetween.

8. A heat exchanger as claimed in claim 7 and further comprising heat transfer fins located in the third fluid conduit in contact with the spaced-apart plates in adjacent modules.

9. A heat exchanger as claimed in claim 1 wherein the undulations are in the form of parallel ribs and grooves.

10. A heat exchanger as claimed in claim 1 wherein the plates are elongate plates having a longitudinal axis, and wherein two of said inlet and outlet openings are located, spaced-apart, at each end of the elongate plates, one of said two openings communicating respectively with each of the first and second conduits.

11. A heat exchanger as claimed in claim 1 wherein the third fluid conduit spaces apart the first and second fluid conduits in one heat exchange module and the first and second fluid conduits in the adjacent heat exchange module, the third fluid being air and flowing in a direction generally transverse to the first and second fluids.

12. A heat exchanger as claimed in claim 2 wherein the third fluid conduit is located on one side of the first and second fluid conduits, and wherein the third fluid conduit of an adjacent heat exchange module is located on the opposite side of said first and second fluid conduits.

13. A heat exchanger as claimed in claim 2 wherein the third fluid conduits are orientated transversely of the first and second fluid conduits.

14. A heat exchanger as claimed in claim 2 wherein both of the spaced-apart plates have said inlet and outlet openings.

15. A heat exchanger as claimed in claim 14 wherein the spaced-apart plates are formed with bosses defining the inlet and outlet openings.

16. A heat exchanger as claimed in claim 15 wherein the bosses extend outwardly, the bosses in adjacent heat exchange modules engaging to form flow manifolds, the spaced-apart plates in adjacent modules thus defining the third fluid conduit therebetween.

17. A heat exchanger as claimed in claim 16 and further comprising heat transfer fins located in the third fluid conduit in contact with the spaced-apart plates in adjacent modules.

18. A heat exchanger as claimed in claim 2 wherein the undulations are in the form of parallel ribs and grooves.

19. A heat exchanger as claimed in claim 2 wherein the plates are elongate plates having a longitudinal axis, and wherein two of said inlet and outlet openings are located, spaced-apart, at each end of the elongate plates, one of said two openings communicating respectively with each of the first and second conduits.

20. A heat exchanger as claimed in claim 2 wherein the third fluid conduit spaces apart the first and second fluid conduits in one heat exchange module and the first and second fluid conduits in the adjacent heat exchange module, the third fluid being air and flowing in a direction generally transverse to the first and second fluids.

* * * * *